United States Patent [19]

Steyert et al.

[11] Patent Number: 4,781,033

[45] Date of Patent: Nov. 1, 1988

[54] HEAT EXCHANGER FOR A FAST COOLDOWN CRYOSTAT

[75] Inventors: William A. Steyert, Center Valley; Ralph C. Longsworth, Allentown, both of Pa.

[73] Assignee: APD Cryogenics, Allentown, Pa.

[21] Appl. No.: 74,303

[22] Filed: Jul. 16, 1987

[51] Int. Cl.[4] ..... F25B 19/00

[52] U.S. Cl. ..... 62/514 JT; 165/10

[58] Field of Search ..... 62/6, 514 JT; 165/10

[56] References Cited

U.S. PATENT DOCUMENTS

| | | | |
|---|---|---|---|
| 3,704,601 | 12/1972 | Campbell et al. | 62/514 JT |
| 3,795,116 | 3/1974 | Burnier et al. | 62/514 JT |
| 3,800,552 | 4/1974 | Sollami et al. | 62/514 JT |
| 3,942,010 | 3/1976 | Peterson et al. | 62/514 JT |
| 4,235,078 | 11/1978 | Morbidi | 62/6 |
| 4,259,844 | 4/1981 | Sarcia | 165/10 |
| 4,429,732 | 2/1984 | Moscrip | 165/10 |
| 4,487,253 | 12/1984 | Malek et al. | 165/10 |
| 4,569,210 | 2/1986 | Albagnac | 62/514 JT |

*Primary Examiner*—Ronald C. Capossela

*Attorney, Agent, or Firm*—Helfgott & Karas

[57] ABSTRACT

A heat exchanger for a fast cooldown cryostat having high pressure and low pressure flow paths wherein a low pressure flow path is defined by a finely divided matrix which in turn defines a plurality of flow paths and said high pressure flow path is disposed in heat exchange relationshp to said matrix.

16 Claims, 4 Drawing Sheets

HEAT EXCHANGER FOR A FAST COOLDOWN CRYOSTAT

TECHNICAL FIELD

This invention pertains to heat exchangers for cryogenic systems most commonly referred to as cryostats. Cryostats are used in cryo-electronic systems such as cooling infra-red detectors and the like. In particular, there is a need for fast cooldown of detectors for missile guidance systems.

BACKGROUND OF THE PRIOR ART

Cryostats utilizing the well-known Joule-Thomson effect or cooling cycle are shown in U.S. Pat. Nos. 3,006,157, 3,021,683, 3,048,021, 3,320,755, 3,714,796, 3,728,868, 4,237,699 and 4,653,284. All of the cryostats shown in the enumerated patents rely upon a heat exchanger wherein high pressure fluid is conducted along a path which is in heat exchange with the cooled lower pressure gas returning after expansion through a Joule-Thomson orifice. In all of the prior art devices, the heat exchanger is constructed by wrapping a finned tube around the outside of a mandrel, the finned tube terminating in a Joule-Thomson orifice. The wrapped tube heat exchanger is disposed in a dewar or other sleeve so that the high-pressure gas conducted down through the finned tube exiting the Joule-Thomson orifice which has expanded to produce refrigeration is conducted countercurrently over the outside of the finned tube to precool the in-coming high pressure gas. One of the problems with heat exchangers of this type which are embodied in cryostats is the lack of fast cool down (response) time. This is especially a problem with cryostats used by the military to cool infra-red detectors in guided missiles. As is well-known, guidance begins when the missile leaves the launcher and that the missile must be fired as soon as possible should the need arise. In general, cryostats of the type employing the finned tube heat exchanger must be operational several seconds before the missile is launched so that it can provide the necessary refrigeration to cool the IR detector and thus, have the missile guidance system in condition to guide the missile to the target. The best response time with a conventional finned tube heat exchanger has been to reach a temperature of 92.4° Kelvin (°K.) in 2.5 seconds at the Joule-Thomson orifice.

A heat exchanger using stacked screens was proposed by G. Bon Mardion and G. Claudet in an article appearing in *CRYOGENICS*, September 1979 entitled "A Counterflow Gas-Liquid Helium Heat Exchanger with Copper Grid". The authors do not disclose how such a heat exchanger would be constructed for use in a fast cool-down cryostat. Mardion and Claudet were not concerned with the mass of the heat exchanger because of the wire sizes employed, thus a fast response (cool-down) time would not be observed for this heat exchanger.

SUMMARY OF THE INVENTION

An effective heat exchanger for achieving fast cool-down in a cryostat is achieved by combining a high-pressure fluid conduit terminating in a Joule-Thomson orifice in heat exchange relationship with a matrix of finely divided material which matrix acts as the flow path for the warmed high pressure fluid. A particularly effective heat exchanger is achieved when a plurality of stacked fine mesh screens are combined in heat exchange relationship with a high pressure tube so that the low pressure return path is through the fine mesh screens. It is possible to achieve an elongated heat exchanger or a flat heat exchanger using this particular combination.

DETAILED DESCRIPTION OF THE INVENTION

Figure 1:
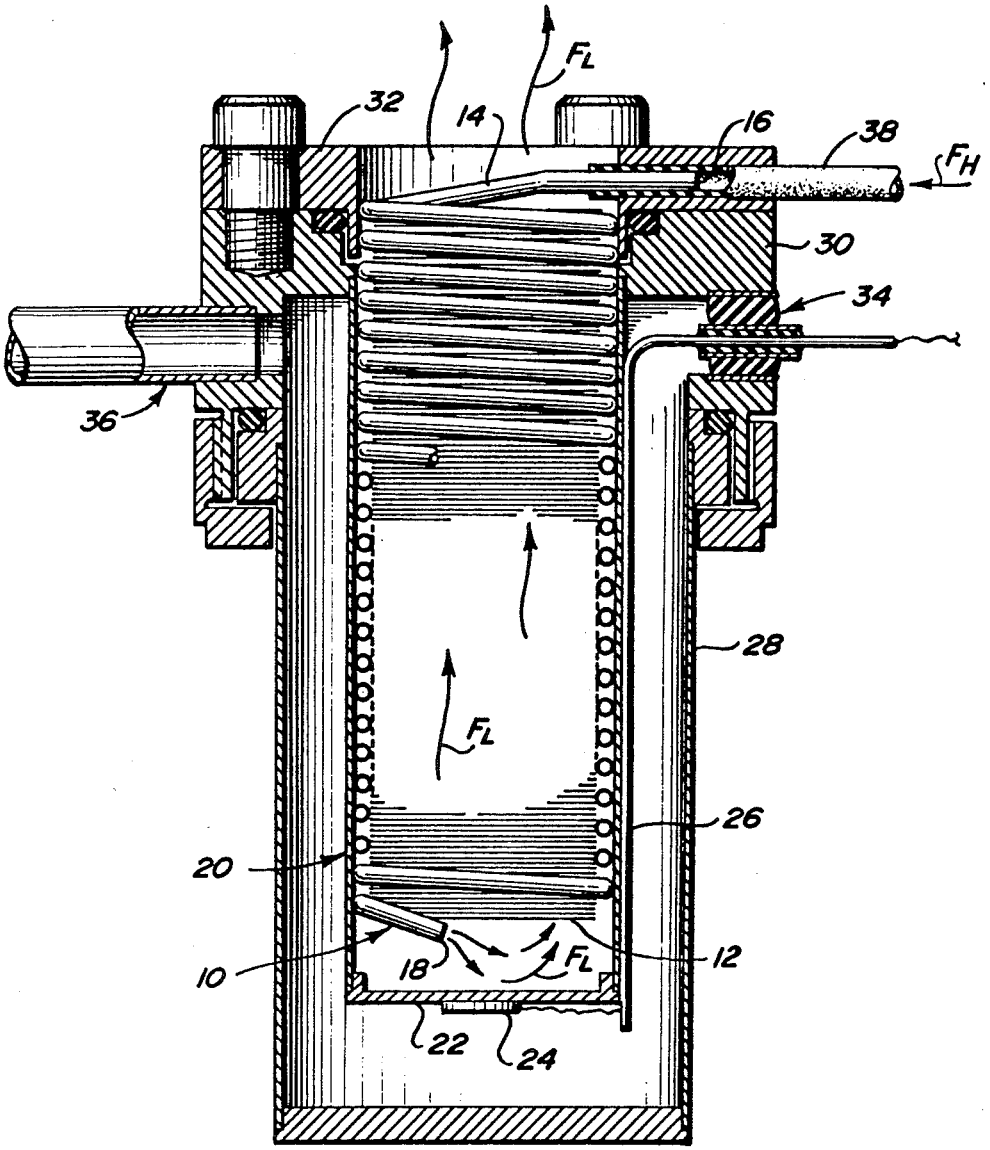
FIG. 1 is an enlarged cross-sectional view of a single circuit cryostat with a heat exchanger according to the present invention.

In order to develop small lightweight Joule-Thomson (J-T) effect cryostats for rapidly producing refrigeration of the type and quantity to immediately cool the infra-red detector in a missile at launch, attention was directed to the heat exchanger used to convey high pressure fluid (e.g., gaseous argon, nitrogen, fluorinated hydro carbons) from a source such as a cylinder or bottle to the Joule-Thomson orifice where the fluid after expansion and production of refrigeration at the Joule-Thomson orifice is conducted over the high pressure tube to precool incoming high pressure fluid.

Conventional cryostats employ a heat exchanger generally constructed by wrapping a small diameter finned tube around a mandrel. The finned tube terminates in a Joule-Thomson orifice. The tube and mandrel structure is placed inside of a dewar or sleeve so that high pressure fluid conducted down through the finned tube and expanded through the Joule-Thomson orifice is forced to leave the area of the Joule-Thomson orifice by flowing over the finned tube to precool the entering high pressure fluid.

Thus, it has been discovered that if an unfinned capillary tube of the type used in prior art heat exchangers is placed in heat exchange (thermal contact) with a matrix of very finely divided material (e.g. wires less than 2.3 mils thick in a mesh array) so that the high pressure fluid is conveyed through the capillary to a Joule-Thomson orifice and the expanded fluid is returned through the finely divided material to precool the incoming high pressure fluid a very rapid cooldown time for a cryostat employing such heat exchanger can be achieved. In the preferred embodiment of the invention the finely dividend matrix is made up of a plurality of fine wires arrayed in the form of a layering of fine wire mesh screens. The use of mesh for heat transfer makes the refrigerator smaller and lighter than those of previous design. It is axiomatic that a lighter refrigerator cools faster. However, with the low-pressure gas, adequate heat exchange is much more difficult. The heat exchange surface for the low-pressure gas must be light weight (therefore, high surface-to-volume ratio), have a high heat transfer coefficient, and have small pressure drop. Tightly spaced fine copper wires are the best media for that critical heat exchange surface. In addition, in order to keep the pressure drop at a minimum it is essential that the low pressure gas not be confined in a tight geometry where its velocity becomes large. This is especially true because the pressure drop in a given media is proportional to its velocity to the 1.75 or second power.

As will be hereinafter described, the advantages of going to a fine wire matrix are manifest in several ways. First, as the wire diameter (d) decreases, the surface-to-volume ratio goes up (this ratio can be shown to be 4/d for long wires). Thus, more heat transfer area is available for a given cool down mass. In addition, the heat transfer coefficient (h) goes up as the wire size decreases as disclosed in the publication Heat Transmission by W. H. McAdams published by McGraw-Hill, New York, N.Y. (1932) wherein the author shows that h equals $(k/d)\ [0.32+0.43\ (d\ G/\mu)^{0.52}]$ where k is the gas conductivity, $\mu$ is its viscosity, and G its mass flow rate. Heat transfer coefficients in screens follow a relation similar to that in wires, except that it is more complicated since it involves taking into consideration the mesh size of the screen.

Referring to FIG. 1, a heat exchanger 10 according to the present invention includes a matrix 12 which can be constructed from a plurality of fine wire mesh screens of a highly conductive material such as copper. Screens having a mesh size of approximately 100 have been found to be particularly effective, but the mesh size can be varied depending upon the performance characteristics for the desired cryostat. Preferably the screens are layered and each screen is oriented 45° to its neighbor to define the flow path as shown by the arrows in FIG. 1. While the preferred embodiment employes fine wire mesh screens, other finely divided materials such as layered wires, sintered porous metals and the like can be used in place thereof. Disposed around and fixed to the matrix 12 in good heat exchange relation therewith is a small diameter capillary tube 14. The capillary tube 14 is preferably fabricated from an alloy of copper having good thermal conductivity. Capillary tube 14 is disposed in such a manner to define an inlet or warm end 16 and an outlet or cold end 18 for the heat exchanger 10. Conventionally cold end 18 terminates in a Joule-Thomson (J-T) orifice (not shown) as is well known in the art.

As shown in FIG. 1, a heat exchanger 10 according to the present invention can be disposed inside of a stainless steel sleeve 20 having an end cap 22 on one end so that when the heat exchanger 10 is inserted in the sleeve there is a space between the cold end 18 of the heat exchanger and the cap 20 for accumulation of liquefied and/or cold fluid. As shown in FIG. 1, the cap 22 includes a temperature sensor (or detector) 24 which is connected via conventional electrical feeds 26 to a temperature monitoring device (not shown). The sleeve 20 and heat exchanger 10 which define a cryostat are disposed inside of a vacuum housing 28 which in turn is fixed to a flange 30 which in turn is held in vacuum tight relationship to a test adaptor 32. Vacuum housing 28 includes suitable feed through ports 34 for the electrical conduits and a vacuum pump out port 36 to evacuate the housing to thus measure the effectiveness of the heat exchanger 10.

The materials of construction of a heat exchanger according to the present invention are generally available from custom metal houses. The materials of construction will depend upon the dimensions of the cryostat and the performance characteristics required.

Cryostats according to FIG. 1 were constructed and tested utilizing various high pressure fluids. The cryostats were connected to a source of high pressure gas via the inlet conduit 38 which is held in fluid tight relation to inlet end 16 of the capillary tube 14 with fluid flows shown by arrows $F_H$ for high pressure and $F_L$ for low pressure.

As set forth in Table 1 below, two different diameter heat exchangers were utilized in the test cryostats which were fabricated and tested using various high pressure fluids. The test was set up as shown in FIG. 1.

TABLE 1

| | | | | | | |
|---|---|---|---|---|---|---|
| Exchanger OD-in. | .130 | → | → | → | .204 | .130 |
| Matrix | | | | | | |
| Material | copper | → | → | → | → | → |
| Mesh | 100 | → | → | 100/150(2) | 100 | 100 |
| # Layers | 100 | → | → | → | → | 150 |
| Orientation(1) | 45° | → | → | Parallel | 45° | 45° |
| OD-in. | .108 | → | → | → | .182 | .108 |
| Tube | | | | | | |
| Material | St. Stl. | → | → | → | → | → |
| OD-in. | .013 | → | → | → | → | → |
| ID-in. | .007 | → | → | → | → | → |
| # Turns | 23 | 23 | 23 | 23 | 23 | 34 |
| Orifice | 2.5 | → | → | → | → | → |
| Co - l/M(3) | | | | | | |
| Gas | $N_2$ | Ar | $CF_4$ | Ar | Ar | Ar |
| Performance | | | | | | |
| NTU(4) | 4 | 5.2 | 3.9 | 6.2 | 7.3 | 7.8 |
| CDT(5) | 2.4 | .3 | .1 | .3 | .3 | .3 |
| T(6)K | 84 | 94 | 151 | 96 | 89 | 96 |

(1)45° means that the wires in each layer of screen are rotated 45° with respect to the adjacent layers.
(2)A 100-mesh screen is alternated with a 150-mesh screen with wires in adjacent screens parallel.
(3)Co = flow rate measured at room temperature with 1000 psi $N_2$.
(4)NTU = number of transfer units.
(5)CDT = calculated cooldown time, with very light cold end caps.
(6)T = calculated temperature at cooldown.

The inlet gas pressure for the test set up was 6,000 psi at the commencement of the test. It is important to note that it is not necessary to cool the cold end 18 of the heat exchanger all the way to 87° K. or 77° K. in order to produce refrigeration at 87° K. or 77° K. at the bottom of the sleeve with argon or nitrogen gas respectively. When the 6,000 psi fluid reaching the Joule-Thomson orifice on the cold end 18 of the heat exchanger 10 is cooled to 220° K. or 180° K. with argon or nitrogen, it produces a mixture of the respective liquefied gas and gaseous argon or nitrogen upon expansion to low pressure. With this phenomenon present the requirement for the most rapid cooldown is that the 6,000 psi fluid, as it expands to lower pressure, not be in thermal contact with the cold end of the refrigerator. The cold end of the refrigerator is still at 229° K. or 180° K. and will heat the expanding fluid which is cooling to 87° or 77° K. respectively. This undesired heating will prevent the cooldown of the bottom of the sleeve 20 until the cold end of the refrigerator has cooled to almost 87° or 77° K. thus the heat exchanger must be configured as shown.

Figure 6A:
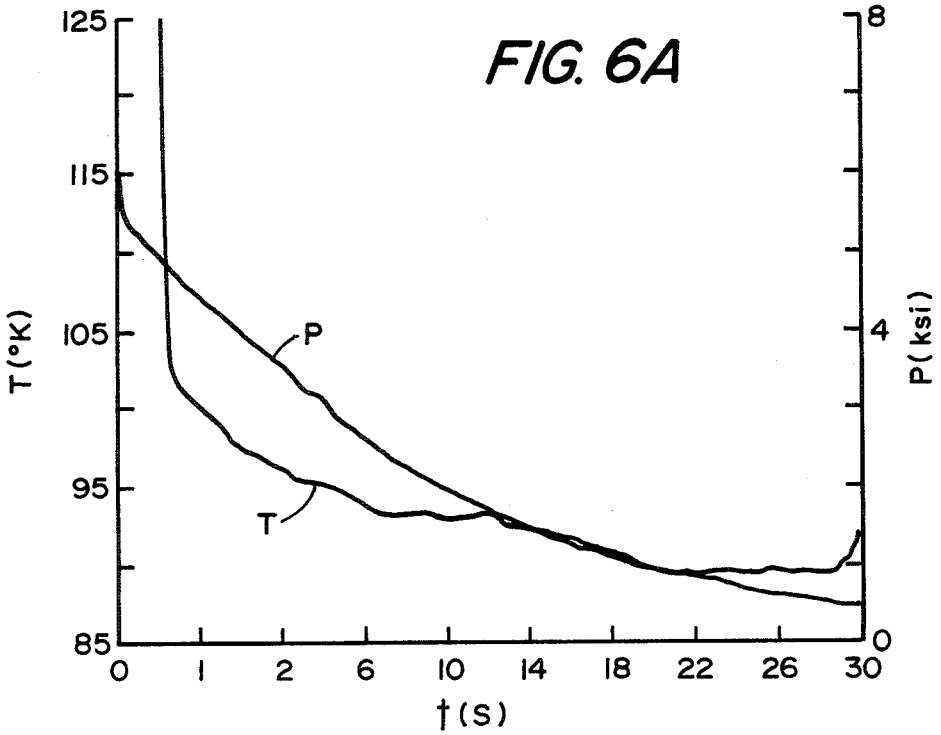
FIG. 6A is a plot of temperature and pressure versus time for a cryostat employing a heat exchanger according to the prior art.
Figure 6B:
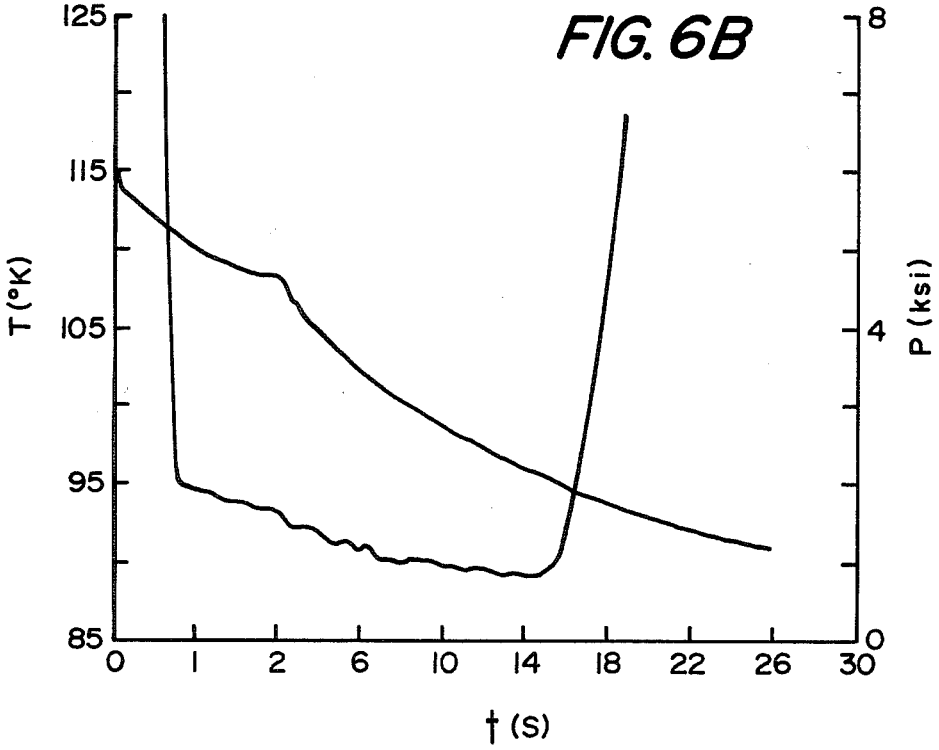
FIG. 6B is a plot of temperature and pressure versus time for a cryostat employing a heat exchanger according to the present invention.

Referring to FIGS. 6A and 6B respectively there is shown a plot of temperature and pressure versus time for, in the case of FIG. 6A, a cryostat with a conventional finned tube heat exchanger such as disclosed in any of the cited prior art and, in the case of FIG. 6B, a cryostat with a heat exchanger according to the present invention. In the case of the finned tube device (FIG. 6A) the heat exchanger had an outside diameter of 0.130 inches and was 1.2 inches long and the cryostat of FIG. 6B was of the same diameter with a length of 0.36 inches. In both cases the tests were run and temperature measured with no vacuum jacketing of the heat exchanger. As is apparent from a comparison of FIGS. 6A and 6B the cryostat with the heat exchanger according to the present invention (FIG. 6B) achieves a temperature of 95° K. in slightly less than 1 second whereas the cryostat of the prior art requires almost 4 seconds to achieve the same temperature. Therefore, a fast cooldown cryostat can be achieved by embodying the heat exchanger of the present invention.

Figure 2:
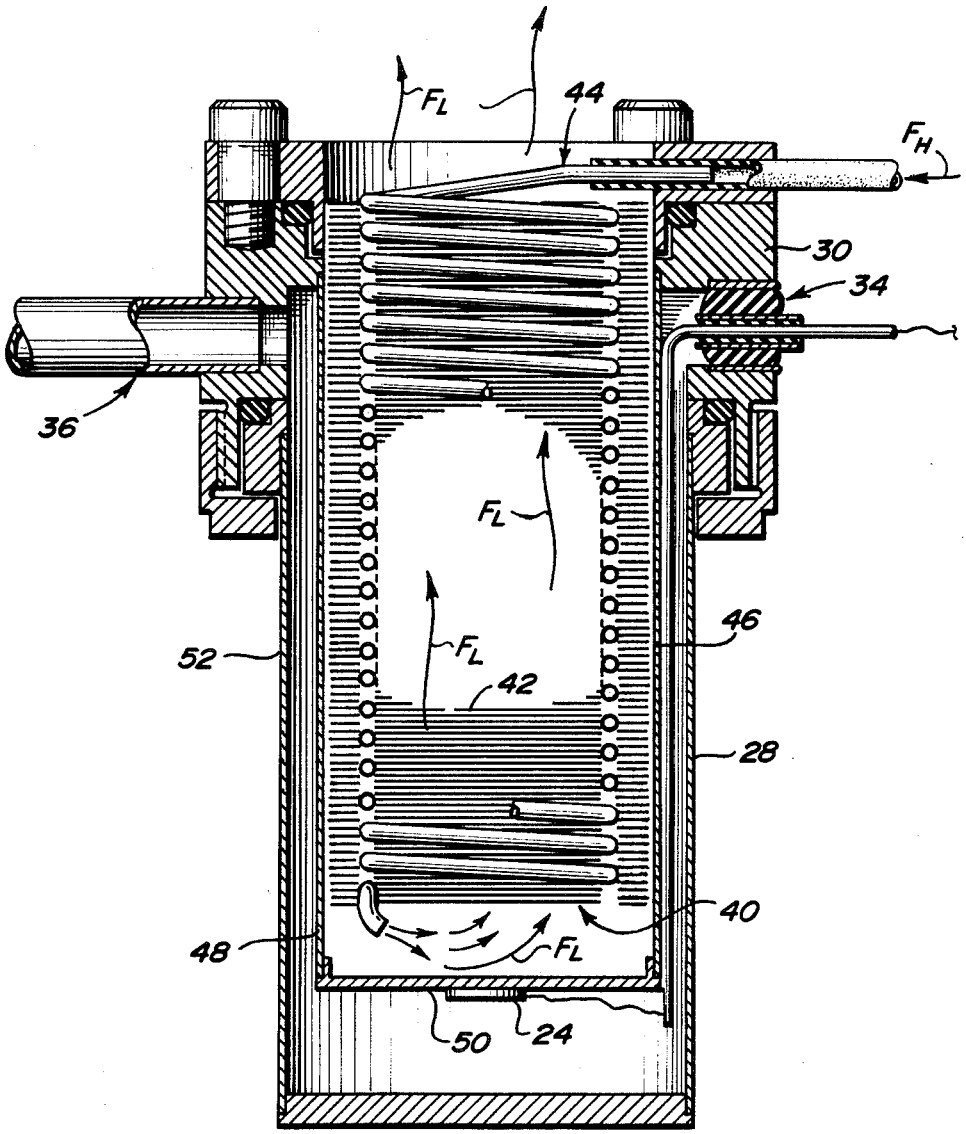
FIG. 2 is an enlarged cross-sectional view of a large diameter single circuit cryostat according to the present invention.

Referring to FIG. 2 there is shown a large diameter cryostat wherein the heat exchanger 40 is constructed by utilizing a plurality of stacked inner screens 42 around which is disposed the capillary tube 44. Disposed around the capillary 44 is a second set of stacked screens 46. The materials of construction can be the same for the heat exchanger of FIG. 2 as for the heat exchanger of FIG. 1. The heat exchanger of FIG. 2 can be disposed within a stainless steel sleeve 48 which has an end cap 50 and which can be disposed in a vacuum housing 52 to be tested in accordance with the test method of the device of FIG. 1. The device of FIG. 2 shows fluid flow using the same nomenclature as in FIG. 1. Comparatively speaking the heat exchanger of FIG. 1 would have an outside diameter of 0.130 inches and a length of 0.40 inches whereas the heat exchanger of FIG. 2 can have an outside diameter of 0.326 inches and a length of 0.60 inches.

Figure 3:
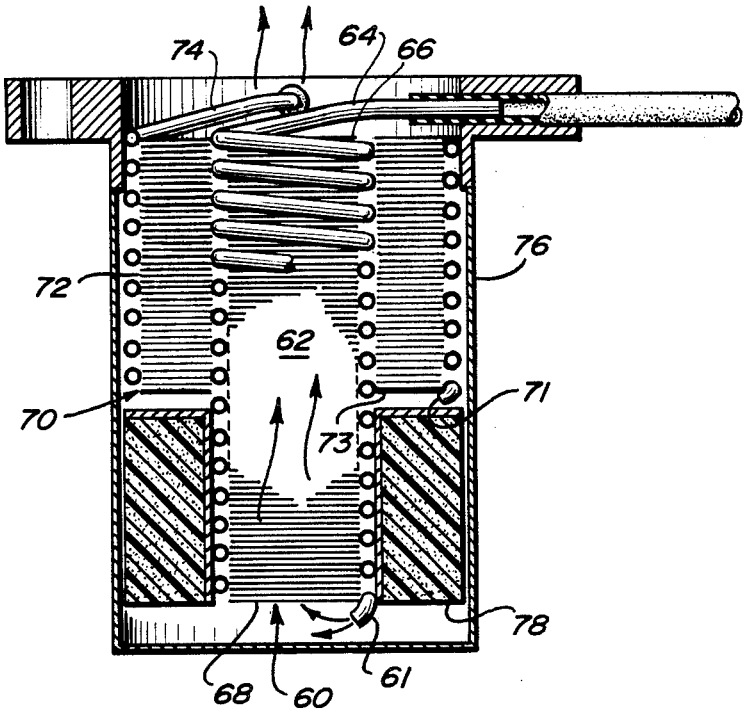
FIG. 3 is an enlarged cross-sectional view of a cryostat employing a dual circuit heat exchanger according to the present invention.

A two-stage cryostat according to the present invention is shown in FIG. 3 wherein there is employed a first heat exchanger 60 which is constructed by stacking a plurality of screens 62 around which is disposed a capillary 64 such as shown and described in relation to FIG. 1.

Disposed around a portion of the first heat exchanger 60 is a second heat exchanger 70 which is constructed from a plurality of stacked annular screens 72 around which is disposed a capillary 74. The second heat exchanger 70 is constructed so that its total length is less than that of heat exchanger 60 and it encircles only a portion of heat exchanger 60 from the warm end 66 toward the cold end 68 of the heat exchanger 60. The dual heat exchanger 60-70 can be disposed inside of a stainless steel sleeve 76. The projecting end of heat exchanger 60 can be kept in position inside sleeve 76 by a foam spacer 78.

The dual heat exchanger of FIG. 3 including a first JT orifice 61 for tube 64 of heat exchanger 60 and a second JT orifice 71 for tube 74 of heat exchanger 70 with the first heat exchanger capillary 64 connected to a source of high pressure fluid such as neon at 100 atmospheres and a second capillary 74 connected to a source of nitrogen at 400 atmospheres with both gases being at a temperature of approximately 300° kelvin (°K.) will produce a temperature of approximately 30° kelvin at the bottom 68 of heat exchanger 60 when tested as shown. A temperature of approximately 83° kelvin is achieved at the bottom of a device according to FIG. 3 if capillary 64 is connected to $N_2$ and capillary 74 is connected to $CF_4$. A device according to FIG. 3 can produce different temperatures at the cold end 68 of heat exchanger 60 by utilizing various combinations of gases (cryogens) as set forth in Table 2.

TABLE 2

| Test No. | Capillary 64 | Capillary 74 | Minimum Temp °K. |
|---|---|---|---|
| 1 | $CF_3Cl$ | AR | 90 |
| 2 | $CF_4$ | AR | 90 |
| 3 | $CF_3Cl$ | $N_2$ | 83 |
| 4 | $CF_4$ | $N_2$ | 83 |
| 5 | $CF_4$ | $N_2$/Ne | 75 |
| 6 | AR | $N_2$/Ne | 75 |
| 7 | AIR | Ne | 32 |
| 8 | $N_2$ | Ne | 32 |
| 9 | AIR | $H_2$ | 25 |
| 10 | $N_2$ | $H_2$ | 25 |

Figure 4:
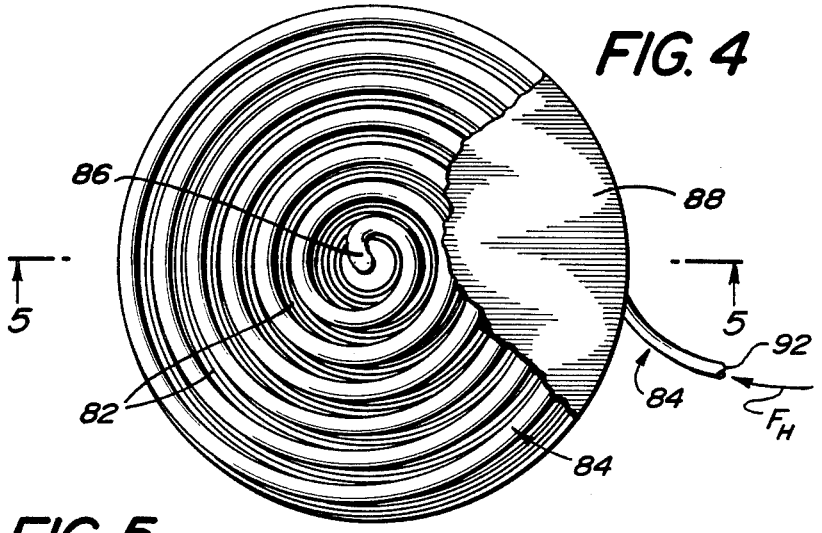
FIG. 4 is a top plan view of a cryostat employing a heat exchanger according to the present invention.
Figure 5:
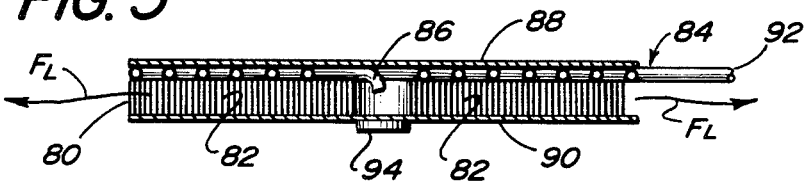
FIG. 5 is a view taken along the line 5—5 of FIG. 4.

Referring to FIGS. 4 and 5 the heat exchanger according to the present invention can be embodied in the form of a flat disc for embodiment into a low profile configuration. As shown in FIGS. 4 and 5 the heat exchanger 80 is constructed by providing an annulus of fine mesh screens 82 which can be fabricated by wrapping the screening around a removeable mandrel. Disposed along one side of the annulus of screens 82 is a capillary 84 which terminates in a Joule-Thomson orifice 86 inside of the annulus of screens 82. The screen and capillary construction is closed by a pair of spaced apart stainless steel discs 88 and 90 so that high pressure fluid shown by arrow $F_H$ conducted from the inlet 92 of capillary 84 to the Joule-Thomson orifice 86 flows radially outwardly between discs 88 80 as shown by the arrow $F_L$. The screening 82 can be achieved by spirally winding one hundred mesh copper screen around a mandrel. As with the other heat exchangers final assembly can be by any conventional technique such as furnace brazing of the assembly. The assembled device of FIGS. 4 and 5 can be used with a detector to be cooled placed as shown as item 94.

It is well known that in conventional infrared detector systems approximately 5 to 10 seconds are required to cool the detector to operating temperatures with conventional Joule-Thomson cryostats. It is very desirable to reduce this cooldown time to the neighborhood of 1 second at temperatures of approximately 90° kelvin so that the infrared detector is ready to function immediately upon being needed. Thus it would be possible to eliminate the need for constant refrigeration in order to keep a device such as a missile in the ready fire condition. This has been achieved with the heat exchanger of the present invention.

Having thus described our invention what is desired to be secured by Letters Patent of the United States is set forth in the appended claims.

We claim:

1. A heat exchanger for a fast cooldown cryostat having in at least one stage the combination of a cold end located proximate to a Joule Thompson orifice, a warm end located proximate to a source of high pressure fluid, said cold end and said warm end being separated by a distance dimension, means for conducting expanded gas from said Joule Thompson orifice the length of said distance dimension to said warm end, said conducting means comprising a matrix defining a plurality of paths for said expanded gas from said Joule Thompson orifice to said warm end, and means for conducting said high pressure fluid from said warm end to said Joule Thompson orifice at said cold end, said high pressure fluid conducting means being in heat exchange relation to said matrix throughout said distance dimension.

2. A heat exchanger according to claim 1 wherein said means for conducting expanded gas is a generally cylindrical elongated sleeve.

3. A heat exchanger according to claim 1 wherein said means for conducting expanded gas consists of a pair of spaced apart generally flat metal discs.

4. A heat exchanger according to claim 1 wherein said matrix consists of a plurality of stacked fine mesh copper screens positioned in said path between said cold end and said warm end of said heat exchanger.

5. A heat exchanger according to claim 4 wherein said high pressure fluid conducting means is disposed around said matrix of stacked screens.

6. A heat exchanger for a fast cooldown cryostat comprising in combination:

a matrix defining a plurality of flow paths for conducting an expanded low pressure fluid from a first or cold end proximate to a Joule Thompson orifice the length of a separation distance to a second or warm end of said heat exchanger proximate to a source of high pressure fluid, and a high pressure fluid conduit disposed around and in heat exchange relation with said matrix extending from said source of high pressure fluid to said Joule Thompson orifice.

7. A heat exchanger according to claim 6 wherein said matrix is a plurality of stacked fine mesh screens.

8. A heat exchanger according to claim 7 wherein said screens have a 100 mesh size and are stacked so that the wires in each screen are disposed at an angle of forty-five degrees to that of its adjacent screens.

9. A heat exchanger according to claim 7 wherein said screens alternately have 100 mesh and 150 mesh openings.

10. A heat exchanger for a fast cooldown cryostat comprising in combination:

a first matrix defining a plurality of flow paths over the distance from a first cold end at a first Joule Thompson orifice of said heat exchanger to a first warm end at a first high pressure fluid source of said heat exchanger, a first high pressure fluid conduit disposed around said and in heat exchange relation to said first matrix to conduct high pressure fluid from said first warm end to said first cold end, said first matrix and said first high pressure conduit defining a first stage of said heat exchanger, a second matrix defining a plurality of flow paths disposed around said first matrix a portion of the distance from said first cold end to said first warm end, said second matrix having a warm end proximate to a source of high pressure fluid and proximate to said first warm end, said second matrix having a cold end proximate a second Joule Thompson orifice separated from said warm end by said distance portion and, a second high pressure fluid conduit disposed around and in heat exchange relation with said second matrix to conduct high pressure fluid from said second warm end to said second cold end.

11. A heat exchanger according to claim 10 wherein said first and second matrix is a plurality of stacked fine mesh screens.

12. A heat exchanger according to claim 10 wherein said screens have a 100 mesh size and are stacked so that the wires in each screen are disposed at an angle of forty-five degrees to that of its adjacent screens.

13. A heat exchanger according to claim 10 wherein said screens alternately have 100 mesh and 150 mesh openings.

14. A heat exchanger for a fast cooldown cryostat comprising in combination:

a pair of generally flat discs having a common axis of revolution, said discs being spaced apart, a high pressure fluid conduit disposed between said discs in a flat helical pattern adjacent one of said discs, said high pressure fluid conduit extending from a warm portion at a high pressure fluid source at the periphery of said discs to a Joule Thompson orifice at a cold portion located at said axis of revolution and, a matrix defining a plurality of flow paths for low pressure fluid from said axis of rotation to said periphery of said discs, said matrix being disposed between said discs and being in heat exchange relation with said high pressure fluid conduit over the distance from said axis of rotation of said periphery of said discs.

15. A heat exchanger according to claim 14 wherein said screens have a 100 mesh size and are wrapped in a toroidal manner.

16. A heat exchanger according to claim 15 wherein said toroid is fixed between said discs so that the axis of said toroid is disposed coincidentally with said axis of revolution of said discs.

* * * * *